US007516911B2

(12) United States Patent
Chung

(10) Patent No.: US 7,516,911 B2
(45) Date of Patent: Apr. 14, 2009

(54) ADJUSTABLE KNIFE-CURTAIN OUTLET STRUCTURE OF CLEANOUT HANDLE

(76) Inventor: Chiu-Chih Chung, No. 31, Lane 275, Sec. 4, Lu Ho Rd., Lu Kan Chen, Chunghua Hsien (TW)

( * ) Notice: Subject to any disclaimer, the term of this patent is extended or adjusted under 35 U.S.C. 154(b) by 0 days.

(21) Appl. No.: 11/416,417

(22) Filed: May 3, 2006

(65) Prior Publication Data

US 2007/0262177 A1 Nov. 15, 2007

(51) Int. Cl.
*B05B 1/00* (2006.01)

(52) U.S. Cl. ..... 239/600; 239/106; 239/119; 239/288; 239/525; 239/530; 239/597; 239/DIG. 4

(58) Field of Classification Search ..... 239/104, 239/106, 119, 600, DIG. 4, 288, 288.3, 288.5, 239/525, 530, 597, 598
See application file for complete search history.

(56) References Cited

U.S. PATENT DOCUMENTS 2,417,222 A * 3/1947 Stine ..... 239/288.5
5,340,029 A * 8/1994 Adams ..... 239/119
5,820,025 A * 10/1998 Troudt ..... 239/119
5,829,680 A * 11/1998 Perret, Jr. ..... 239/119

* cited by examiner

*Primary Examiner*—Steven J Ganey
(74) *Attorney, Agent, or Firm*—Troxell Law Office PLLC

(57) ABSTRACT

An adjustable knife-curtain outlet structure of cleanout handle, its features are as follows: outlet of cleanout handle is designed as layer lockup phase, grove to cover O-ring is set inside each screw thread; the small diameter screw thread of lockup phase is locked up with inlet thread groove of water spray joint, and the big diameter screw thread locks up bushing so as to assemble joint and bushing, O-ring can in deed prevent leaking at assembly position, furthermore, bushing can be easily demounted to wash, water spray joint can be turned around.

6 Claims, 4 Drawing Sheets

ADJUSTABLE KNIFE-CURTAIN OUTLET STRUCTURE OF CLEANOUT HANDLE

BACKGROUND OF THE INVENTION

1) Field of the Invention

This invention relates to an adjustable knife-curtain outlet structure of cleanout handle, outlet of cleanout handle is designed as layer lockup phase, O-ring covers internal groove of screw thread; the small diameter screw thread of lockup phase is locked up with water spray joint, and the big diameter screw thread locks up bushing so as to finish demountable assembly between joint and bushing, O-ring can in deed prevent leaking at assembly position, furthermore, bushing can be easily demounted to wash, water spray joint can be turned around.

2) Description of the Prior Art

According to the traditional structure of cleanout handle, please refer to FIG. 1, operating handle 12 with outlet 11 controls cleanout handle 1, knife-curtain outlet joint 14 is connected with outlet 13, bushing 15 covers knife-curtain outlet joint 13 so that water spraying out from knife-curtain joint 14 may not spray out irregularly due to cover of bushing 15, so, you can economize water accordingly.

SUMMARY OF THE INVENTION

Problem to Solve

A. Above structure is assembled fixedly, namely, knife-curtain joint 14 is fixed with bushing 15, so, outlet joint 14 cannot be turn around, water curtain of outlet 16 is to provide water in a single and fixing mode, therefore, it isn't practical and convenient.

B. Fixing position of bushing is easy to rebound water so that dirt on surface of cleaning material may spray back and enter into bushing to stock up, because bushing is fixed that cannot be dismantled to wash, so, its inside is very dirty.

Solution (1) Outlet of cleanout handle is designed as layer lockup phase, O-ring covers internal groove of screw thread; the small diameter screw thread of lockup phase is locked up with water spray joint, the big diameter screw thread locks up bushing so as to finish demountable assembly between joint and bushing, therefore, O-ring can prevent leaking at assembly position, furthermore, bushing can be easily demounted to wash, water spray joint can be turned around.

(2) Owing to the demountable assembly of this structure, it is convenient to get washed, O-ring is replaceable, which can effectively stop water and further improve water-stopping effect due to the newly replaced O-ring.

(3) The outlet can adjust spraying direction as required so as to promote application convenience of cleanout handle basing on rotating adjustment of water spray joint.

DETAILED DESCRIPTIONS OF DRAWINGS

DETAILED DESCRIPTION OF THE PREFERRED EMBODIMENTS

Figure 4:
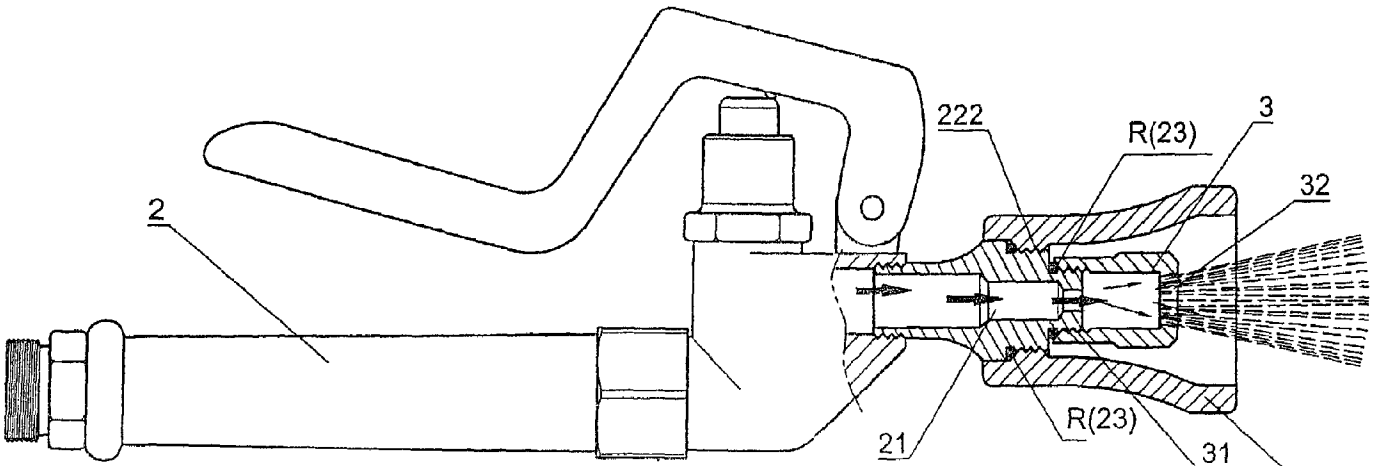
FIG. 4 is the combination section view of this invention.
Figure 1:
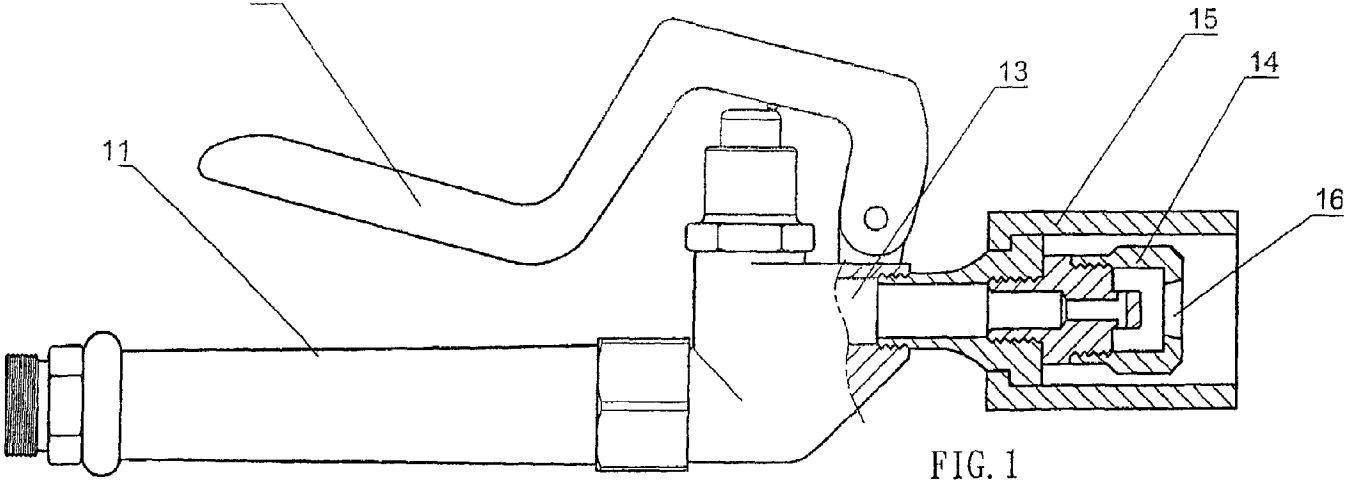
FIG. 1 PRIOR ART
FIG. 1 is the sketch map of prior art.
Figure 2:
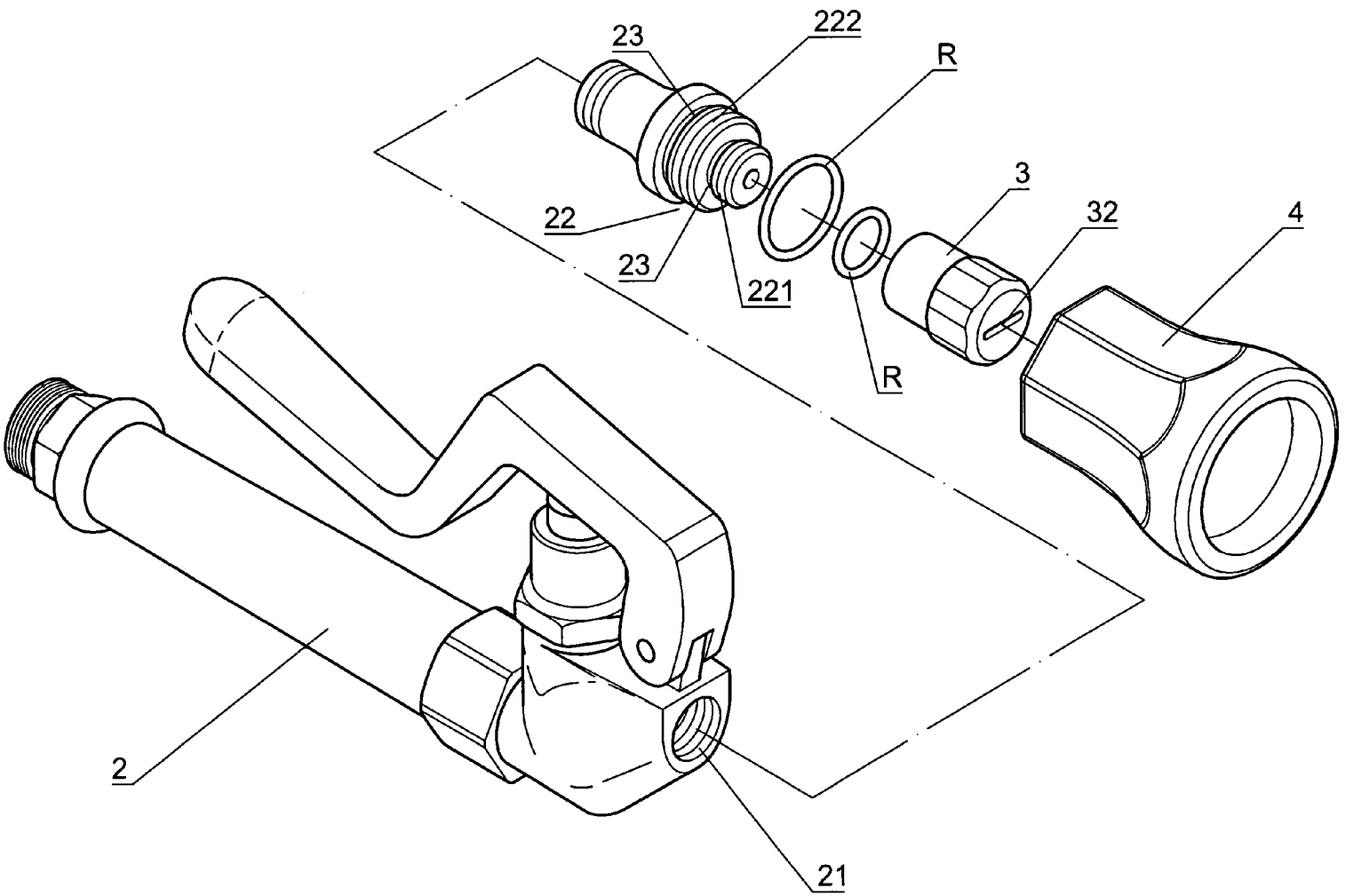
FIG. 2 is the exploded view of structure of this invention.
Figure 3:
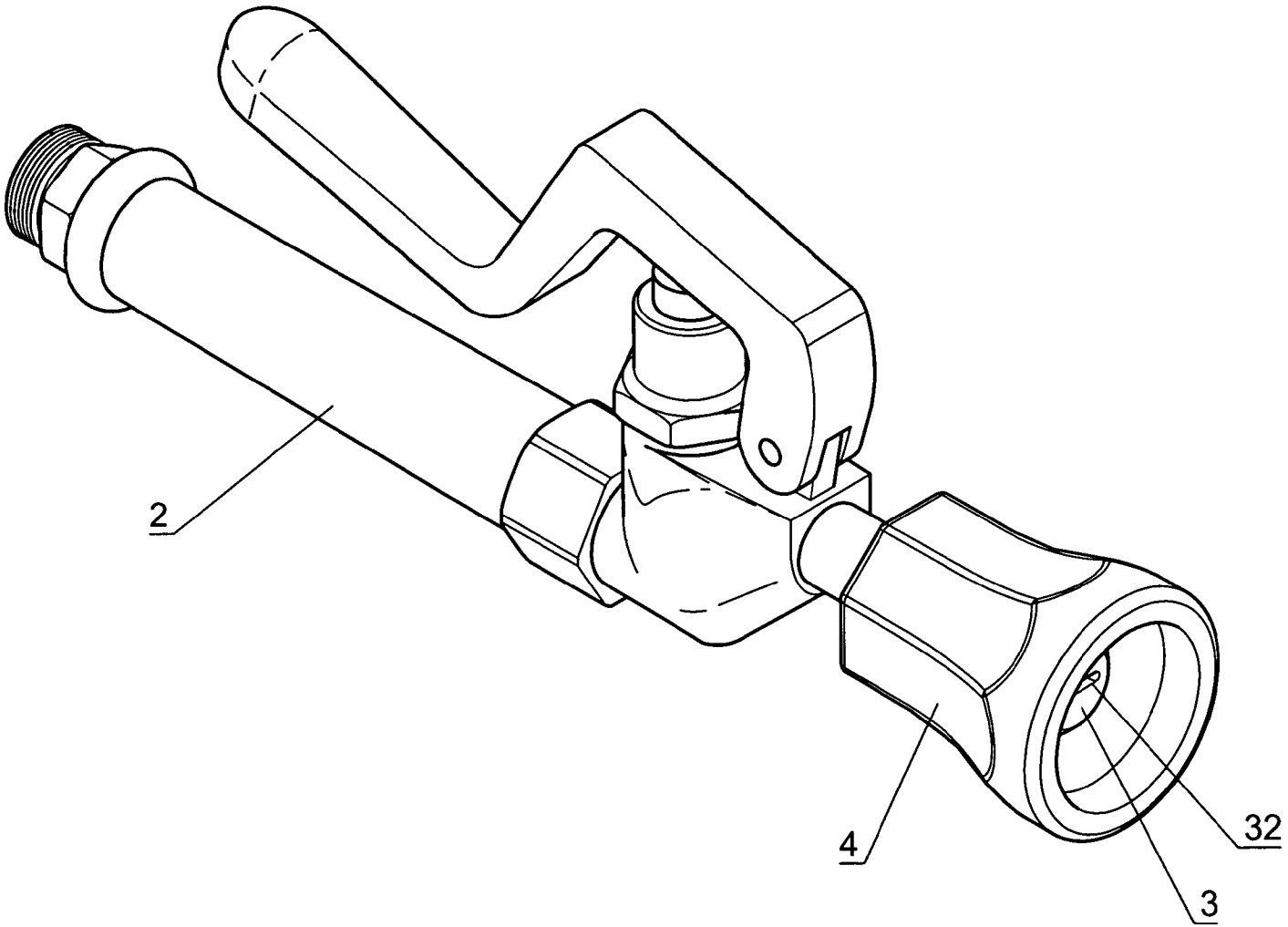
FIG. 3 is the exploded combination view of structure of this invention.
Figure 5:
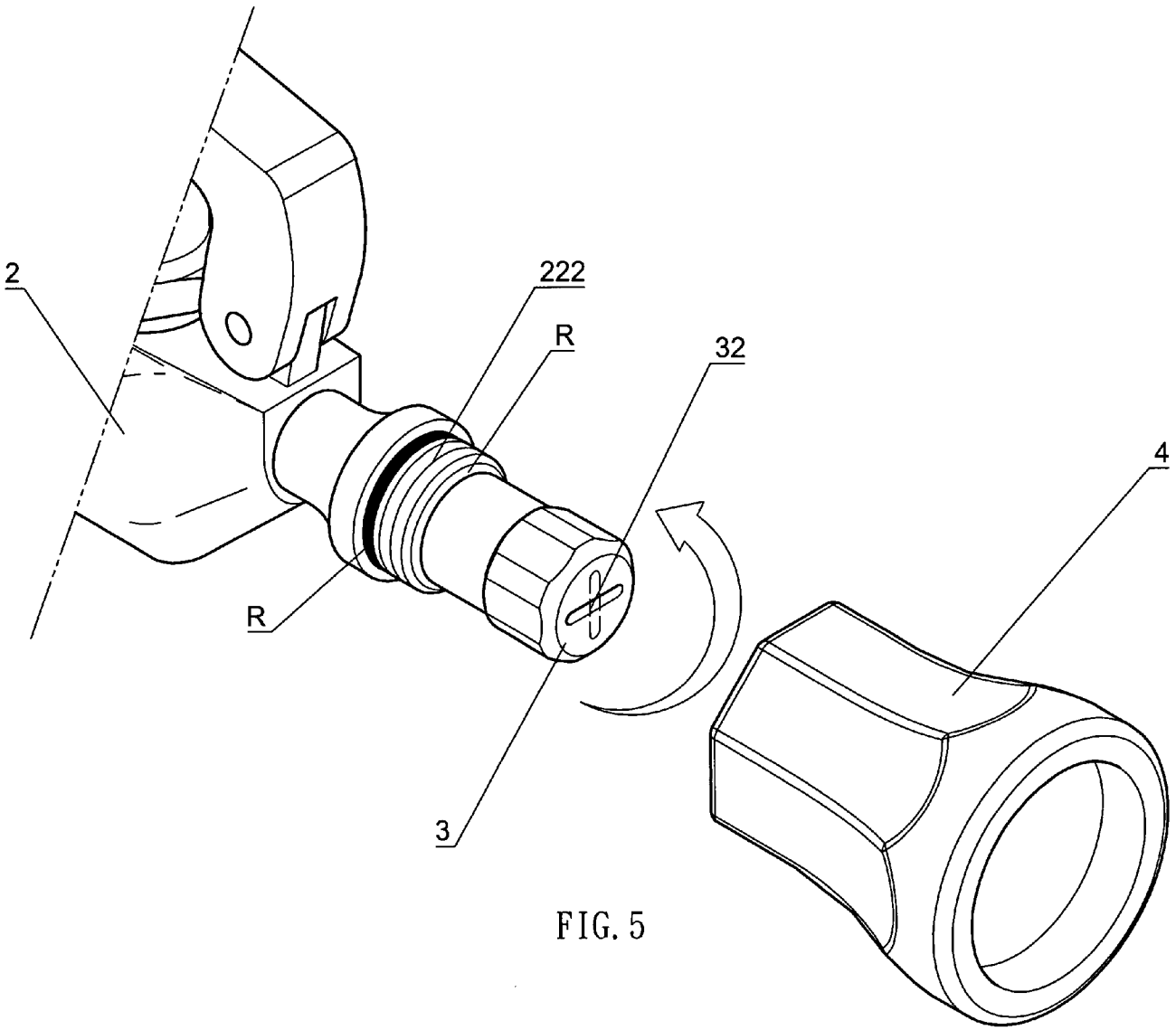
FIG. 5 is the turning operation sketch map of water spray joint of this invention.

Please refer to FIG. 2, FIG. 3, FIG. 4 and FIG. 5, where you can understand structure of this invention. This invention is to design outlet 21 of cleanout handle as layer screw thread lockup phase 22, groove 23 to cover O-ring R is set at small and big diameter screw thread 221 and 222; small diameter screw thread 221 of lockup phase is connected with inlet thread groove 31 of water spray joint 3, and big diameter screw thread is locked up with bushing 4.

Thereby, joint 3 is assembled with bushing 4, O-ring R can seal assembly surface so as to avoid leaking (refer to FIG. 3-A), furthermore, bushing 4 can be dismantled to wash, water spray joint 3 can utilize pressing clearance of O-ring as required to turn outlet 32 freely (see FIG. 4), therefore, cleanout handle is practical.

What is claimed is:

1. An adjustable knife-curtain outlet structure, adapted to be connected to a cleanout handle, comprising:

a) a lockup phase having:

i) a first end adapted to be connected to an outlet of the cleanout handle;

iii) a smaller threaded portion located on a second end thereof; and iv) a larger threaded portion located between the first end and the smaller threaded portion;

b) a water spray joint threadedly connected to the smaller threaded portion of the lockup phase; and c) a bushing threadedly connected to the larger threaded portion of the lockup phase, wherein the adjustable knife-curtain outlet structure further comprises a smaller O-ring sealing a connection between the lockup phase and the water spray joint, the lockup phase having a smaller threaded portion groove located adjacent to the smaller threaded portion, and the smaller O-ring is located in the smaller threaded portion groove.

2. The adjustable knife-curtain outlet structure according to claim 1, wherein an exterior of the bushing is adapted to communicate with the outlet of the cleanout handle through an outlet in the water spray joint.

3. The adjustable knife-curtain outlet structure according to claim 1, wherein the water spray joint and the bushing are spaced apart.

4. An adjustable knife-curtain outlet structure, adapted to be connected to a cleanout handle, comprising:

a) a lockup phase having:

i) a first end adapted to be connected to an outlet of the cleanout handle;

iii) a smaller threaded portion located on a second end thereof; and iv) a larger threaded portion located between the first end and the smaller threaded portion;

b) a water spray joint threadedly connected to the smaller threaded portion of the lockup phase; and c) a bushing threadedly connected to the larger threaded portion of the lockup phase, wherein the adjustable knife-curtain outlet structure further comprises a larger O-ring sealing a connection between the lockup phase and the bushing, the lockup phase having a larger threaded portion groove located adjacent to the larger threaded portion, and the larger O-ring is located in the larger threaded portion groove.

5. The adjustable knife-curtain outlet structure according to claim 4, wherein an exterior of the bushing is adapted to communicate with the outlet of the cleanout handle through an outlet in the water spray joint.

6. The adjustable knife-curtain outlet structure according to claim 4, wherein the water spray joint and the bushing are spaced apart.

* * * * *